US005575127A

United States Patent [19]

O'Neal

[11] Patent Number: 5,575,127

[45] Date of Patent: Nov. 19, 1996

[54] SIDING ATTACHMENT SYSTEM

[76] Inventor: Jerry D. O'Neal, 701 SW. Gulfport, Lee's Summit, Mo. 64081

[21] Appl. No.: 377,210

[22] Filed: Jan. 24, 1995

[51] Int. Cl.[6] ..... E04D 1/34

[52] U.S. Cl. ..... 52/520; 52/531; 52/544; 52/545; 52/551; 52/553; 52/573.1

[58] Field of Search ..... 52/519, 520, 521, 52/522, 529, 530, 531, 535, 543, 544, 545, 546, 547, 551, 553, 554, 573.1; 411/390, 478

[56] References Cited

U.S. PATENT DOCUMENTS

| | | | |
|---|---|---|---|
| Re. 24,675 | 7/1959 | Zarnowski | 52/529 X |
| 2,126,676 | 8/1938 | Thomas | 52/520 |
| 2,128,495 | 8/1938 | Murphy | 52/520 |
| 2,293,744 | 8/1942 | Miles et al. . | |
| 2,325,124 | 7/1943 | Gardner | 52/521 |
| 2,535,620 | 12/1950 | Alvarez, Jr. . | |
| 2,632,538 | 3/1953 | Schmidt, Jr. | 52/520 |
| 2,648,104 | 8/1953 | Scott et al. . | |
| 3,110,130 | 11/1963 | Trachtenberg | 52/545 |
| 3,173,229 | 3/1965 | Weber . | |
| 3,233,382 | 2/1966 | Graveley, Jr. . | |
| 3,258,887 | 7/1966 | Mostoller | 52/547 X |
| 3,504,467 | 4/1970 | Hatch et al. . | |
| 3,520,099 | 7/1970 | Mattes . | |
| 3,703,062 | 11/1972 | McKinney | 52/545 |
| 3,738,076 | 6/1973 | Kessler . | |
| 3,757,483 | 9/1973 | Tobett . | |
| 3,824,756 | 7/1974 | Kessler | 52/546 |
| 3,999,348 | 12/1976 | Hicks . | |
| 4,063,395 | 12/1977 | Stewart et al. | 52/309.8 X |
| 4,186,538 | 2/1980 | Marcum, Jr. . | |
| 4,292,781 | 10/1981 | Chalmers et al. | 52/551 X |
| 4,327,528 | 5/1982 | Fritz . | |
| 4,348,849 | 9/1982 | Wollam et al. . | |
| 4,424,655 | 1/1984 | Trostle . | |
| 4,435,933 | 3/1984 | Krowl . | |
| 4,646,501 | 3/1987 | Champagne et al. . | |
| 4,782,638 | 11/1988 | Hovind . | |
| 5,150,555 | 9/1992 | Wood . | |

OTHER PUBLICATIONS

Exhibit A comprises photographs of a siding clip which to the knowledge of the applicant has been offered for sale by Wolverine Technologies of Livonia, Michigan for at least one year prior to the date of execution of this document. The clip is marked US Pat No. 5,150,555.

*Primary Examiner*—Wynn E. Wood
*Assistant Examiner*—Laura A. Saladino
*Attorney, Agent, or Firm*—Litman, McMahon and Brown, L.L.C.

[57] ABSTRACT

A siding attachment system includes a bracket and a clip for use in securing conventional siding panels to a wall. The bracket comprises a vertical extending web having legs extending rearwardly from a rear surface of the web at upper and lower ends of the web. A shoulder extends forwardly and downwardly from the front surface of the web at the lower end of the web. The shoulder is insertable in a channel formed in a rear surface of conventional siding. The shoulder supports the siding panel but permits the panel to slide longitudinally with respect to the bracket. A plurality of nail holes are uniformly spaced in linear alignment across a top portion of the web along its entire length. Nails or related fasteners may be selectively driven through the nail holes for securing the bracket to a wall. The siding clip generally comprises a rectangular sheet having a height corresponding to the height of the web and having at least one nail hole extending through an upper portion thereof. The clip is positionable against and securable to the bracket after a siding panel has been secured to the bracket such that a nail flange of the panel extends between a lower portion of the clip and a lower portion of the web and is permitted to slide longitudinally therebetween.

23 Claims, 2 Drawing Sheets

SIDING ATTACHMENT SYSTEM

BACKGROUND OF THE INVENTION

The present invention relates to the attachment of vinyl or metal siding to a building and in particular to a bracket for use in attaching siding to a building.

Metal and plastic siding are commonly used as an imitation and substitute for wooden lap siding. The metal and plastic siding provide the appearance of wood siding while generally having a longer life span and require less maintenance. Metal siding is typically formed of aluminum or steel while plastic siding is conventionally formed of extruded sections of thermoplastic polyvinyl chloride which is commonly referred to as vinyl siding. In both types of siding, the bottom margin of each panel is typically bent inwardly and then upwardly to form a longitudinal channel with an upstanding inner leg. The top portion of each panel is formed to provide an outwardly and downwardly projecting longitudinal lip corresponding to the channel running along the bottom of the panel positioned thereabove. A securement flange extends above the longitudinal lip of each panel. The panels are typically secured to a wall along their top portions utilizing fasteners driven through the securement flange extending along the top of each panel.

One problem common to both metal and vinyl siding is its tendency to expand and contract with changes in temperature. Because of this problem, it has been a practice to incorporate longitudinally extending nail slots along the securement flange through which nails may be driven. It is intended that the nails be driven into the slots a distance sufficient to support the siding but not far enough that the head of the nail would engage the siding pressing it against the side of the building and preventing slidable movement of the siding along the nail through expansion and contraction of the siding. The primary problem with such nail slots is the difficulty in driving a nail or other fastener through the nail slots without fastening the nail too tight thereby preventing slidable movement. This is particularly true when the fasteners are applied utilizing power tools.

Siding clips as shown in U.S. Pat. Nos. 4,435,933 and 5,150,555 have been developed to overcome the problem of nailing siding too tightly to the wall to which it is secured. Each of the clips generally includes an upper hanger portion which may be nailed to the wall to which the siding is to be secured and a lower portion shaped to receive the upper portion of the siding in a channel or slot while allowing the siding to freely slide laterally through expansion and contraction. One drawback to such clips is that in use it is generally time consuming to slide a large number of clips onto long sections of siding from the ends to provide the appropriate number of clips for supporting the siding. Further, it is then difficult to maneuver the siding with the clips secured thereto prior to securement to the building without having the clips slide off the end of the siding.

An additional problem associated with conventional methods for hanging siding which is not corrected through use of siding clips is the tendency of vinyl siding to conform to irregularities or bows of a wall. Because vinyl siding is extremely flexible, the siding will conform to the shape of the wall to which it is attached when it is secured thereto by nailing or through the use of the clips noted above. As a building settles and ages, movement of the foundation and warping, racking or twisting of wood framing members through weathering and natural drying processes results in irregularities and distortions of the wall surface of the building. The materials of construction of a wall to which siding is to be attached may present inherently irregular surfaces such as stucco walls, stone walls or other types of siding. In addition, other factors, such as sloppy construction may cause distortion of the wall surface of a building such that the surface is not flat and is wavy or undulates. Current fastening systems for siding are inadequate to prevent the siding from conforming to such irregularities in the shape of building walls.

Although metal siding tends to be more rigid than vinyl siding, sections of metal siding spanning inward bows on a wall on which it is hung are insufficiently rigid to prevent indentation and permanent deformation of the siding when pressure is exerted against the section of siding spanning such an inward bow. Existing siding attachment systems do not provide sufficient additional rigidity to prevent such permanent deformation.

Another drawback of existing siding attachment systems including nailing and the use of clips is uneven sagging. Over time the siding tends to sag. When nails or clips are use to support siding the nails or clips are generally driven into or secured to the framing studs spaced sixteen inches apart such that the siding panels are supported every sixteen inches but not therebetween. Over time the unsupported sections of the siding panel will droop or sag further than the supported sections resulting in an uneven, wavy appearance.

SUMMARY OF THE INVENTION

The present invention comprises a siding attachment system including a siding attachment bracket and a siding attachment clip which are adapted to support conventional siding panels of the type having upper and lower edges which are interconnectable with upper and lower edges of vertically adjacent panels.

The type of siding panels for which the present invention is designed to support are the type having a lower edge which projects rearwardly from a front surface of the panel and upwardly to form a longitudinal channel with an upstanding inner leg. The top portion of each panel is formed to provide an outwardly and downwardly projecting longitudinal lip extending forwardly from a front surface of the panel. The downwardly projecting longitudinal lip forms a downwardly opening channel which is adapted to receive the upstanding inner leg on the bottom edge of the next panel positioned thereabove such that the lip of one panel interlocks with the upstanding inner leg of another panel.

An upwardly and rearwardly opening L-shaped channel is formed in the downwardly projecting longitudinal lip and opens to the rear surface of the panel. A securement flange extends above the longitudinal lip of each panel. The securement flange may include slots or nail holes through which fasteners may be driven for supporting the panel.

The siding attachment bracket generally comprises a vertically extending web having at least one and preferably two support legs extending rearwardly therefrom. A siding support shoulder including a horizontal leg and a vertical leg extends forwardly from the web at a lower end thereof. The horizontal leg is connected to the web at a first end and extends forwardly from the web and ends at a distal end. The vertical leg extends downwardly from the distal end of the horizontal leg.

The siding support shoulder is positionable in the upwardly and rearwardly opening L-shaped channel such that the panel is generally supported on the horizontal leg of the bracket and free to advance along the length of the horizontal leg such as through expansion and contraction.

The siding attachment brackets may be cut or formed to any length but are preferably cut to a length generally equal to the length of the wall or surface onto which the siding is to be attached. Nail holes are formed along an upper portion of the web for receiving fasteners used to secure the bracket to a wall. Nail slots may be formed along a lower portion of the web and sized and positioned to correspond to nail slots formed in the securement flange of conventional siding such that fasteners may be driven into the wall through the nail slots in both the siding and the bracket.

The rigidity of the bracket prevents the bracket from conforming to the contours and irregularities in the wall to which it is secured such that the siding secured thereto presents a flat surface as opposed to an undulating or wavy surface. Further support of the siding by the bracket along its entire length eliminates uneven sagging of siding panels which occurs in systems wherein the siding is supported by clips or nails typically spaced sixteen inches apart along the studs.

The siding attachment system may also include a siding clip. The siding clip generally comprises a rectangular sheet having upper and lower portions and whose height corresponds to the height of the web. Nail holes, preferably two, are formed in the upper portion of a clip to correspond to nail holes in the web. After a panel of siding is secured to the bracket, siding clips are generally positioned against a front surface of the web such that nail holes in the clip align with nail holes in the web and the securement flange of the siding panel is positioned between the lower portion of the clip and the web. The clips are preferably spaced sixteen inches apart to align with framing studs and nails or other fasteners are then driven through the aligned nail holes in the clips and the bracket for securing the system to the wall to which the panel is to be secured. The clips reduce the likelihood of siding panels being peeled or blown off the brackets from extremely high winds.

OBJECT AND ADVANTAGES OF THE INVENTION

Therefore it is an object of this invention to provide a system for attaching siding to a wall or other planar surface; to provide such a system which prevents the siding from conforming to irregularities in the wall surface; to provide such a system which permits the siding to expand and contract along its length; to provide such a system which prevents uneven vertical expansion or sagging of siding panels; to provide such a system which supports each panel of siding generally along its entire length; to provide such a system which provides sufficient rigidity to resist bending of metal siding extending across inward bows on a wall to which it is hung; to provide such a system which is relatively easy to install; to provide such a system which will securely hold siding panels to a wall; to provide such a system which resists damage from high winds; to provide such a system which is designed for use with conventional siding panels produced by a wide range of manufacturers; to provide such a system which is relatively inexpensive to manufacture and to install.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
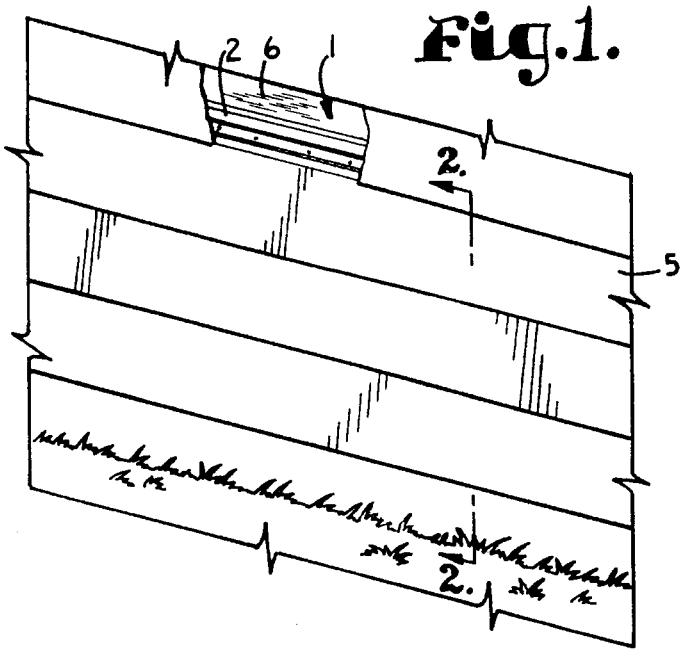
FIG. 1 is a fragmentary, perspective view of an outer wall of a building having siding panels attached thereto with portions broken away to show a siding bracket of the present invention.
Figure 2:
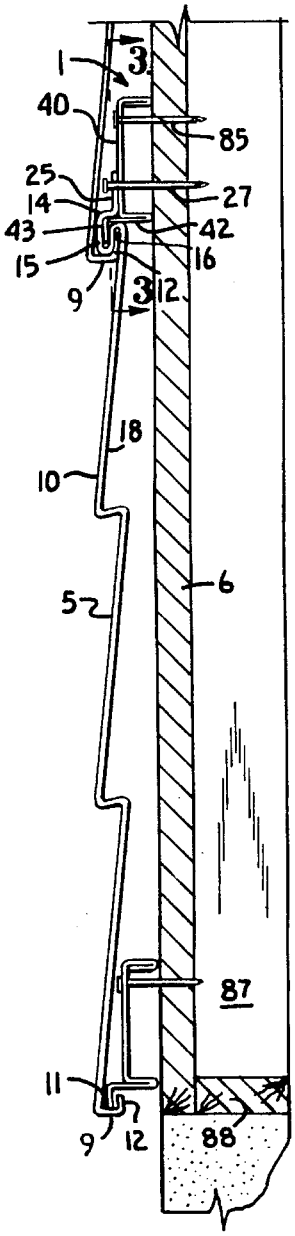
FIG. 2 is an enlarged and fragmentary cross-sectional view generally taken along line 2—2 of FIG. 1 generally showing the method of attachment of siding panels to the siding brackets of the present invention.
Figure 3:
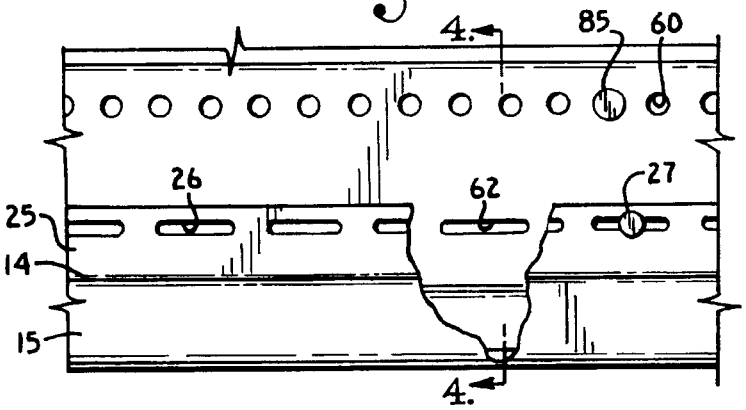
FIG. 3 is an enlarged and fragmentary cross-sectional view generally taken along line 3—3 of FIG. 2 with portions broken away to show detail of the siding bracket of the present invention.
Figure 7:
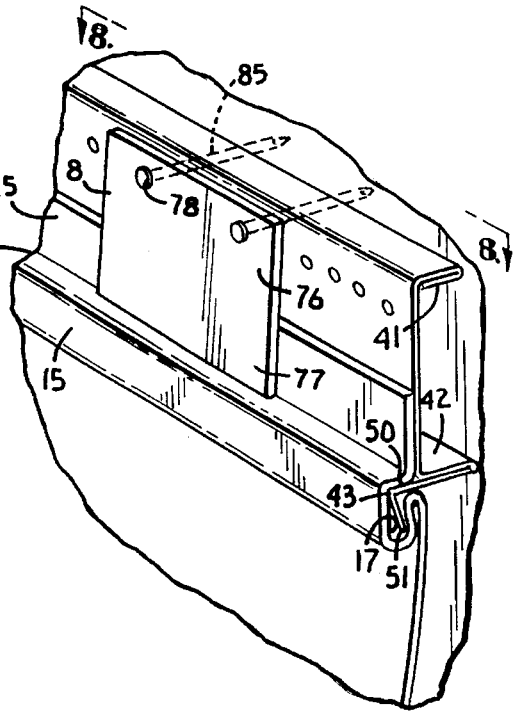
FIG. 7 is a fragmentary perspective view showing a siding panel secured to a siding bracket of the present invention and further incorporating a siding clip for more securely fastening the siding panel to the bracket.

Referring to the drawings in more detail the reference numeral 1 generally refers to a siding attachment system of the present invention which includes a siding bracket 2 shown in FIGS. 1–3 supporting and securing a siding panel 5 to the outer wall 6 of a building. The system 1 also includes an optional siding clip 8 as shown in FIG. 7.

For the purposes of this application, the orientation of the component parts of the siding attachment system and siding panels are described in terms of their orientation when secured to a vertical wall as shown in FIGS. 1–3.

The system 1 is designed to support the type of siding panels 5, as shown in FIG. 2, having a lower edge 9 which projects rearwardly from a frontal surface 10 thereof and upwardly to form an upwardly directed longitudinal channel 11 with an upstanding inner leg 12. A top portion 14 of each panel 5 is formed to provide an outwardly and downwardly projecting longitudinal lip 15. The downwardly projecting longitudinal lip 15 forms a downwardly opening channel 16 which is adapted to receive the upstanding inner leg 12 on the lower edge 9 of the next panel 5 positioned thereabove such that the lip 15 of one panel 5 interlocks with the upstanding inner leg 12 of the panel 5 positioned thereabove.

The siding panels 5 are formed from a single sheet of material. The downwardly projecting longitudinal lip 15 is generally formed by a fold in the material forming the panel 5. The fold in the material forms an upwardly and rearwardly opening L-shaped channel 17 in the downwardly projecting longitudinal lip 15 which opens to a rear surface 18 of the panel 5.

A securement flange 25 extends above the longitudinal lip 15 of each panel 5. The securement flange 5 may include elongate nail slots 26 through which fasteners such as nails 27 may be driven for supporting the panel 5. The slots 26 are designed to permit lateral movement of the siding panel 5 through expansion and contraction when the panel 5 is secured to a wall by nails or similar fasteners.

The siding attachment bracket 2 comprises a vertically extending web 40, upper and lower support legs or flanges 41 and 42 and siding support shoulder 43. The upper support leg 41 extends rearwardly from the web 40 at an upper end thereof and the lower support leg 42 extends rearwardly from the web 40 at a lower end thereof. The support legs 41 and 42 are preferably of equal length. The siding support shoulder 43 includes a horizontal leg 50 and a vertical leg 51. The horizontal leg 50 of the shoulder 43 extends forwardly from the web 40 at a lower end thereof. The vertical leg 51 extends downwardly from a distal end of the horizontal leg 50.

Figure 4:
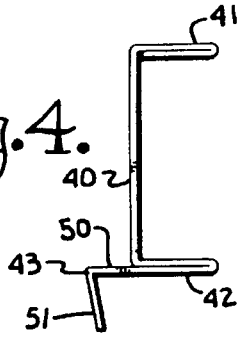
FIG. 4 is a cross-sectional view of the siding bracket generally taken along line 4—4 of FIG. 3.

The bracket 2 is formed from a single thin sheet of rigid yet malleable or bendable material such as aluminum which is folded to form the web 40, legs 41 and 42 and shoulder 43 as shown in FIG. 4. In particular, the material, laying horizontally is folded over and on top of itself 360 degrees generally to form the upper support leg 41. The material is then folded downward 90 degrees to form the web 40. The material is then folded rearwardly 90 degrees and back forwardly 360 degrees to form the lower support leg 42 and the horizontal leg 50 of the siding support shoulder 43. The material is then folded downwardly 90 degrees to form the support shoulder vertical leg 51. It is foreseen that the bracket may also be formed from other relatively rigid materials including plastic through molding or extrusion.

Nail holes 60 are punched or otherwise formed in an upper portion of the web 40. The holes 60 are formed in the web 40 an equal distance apart along a single line extending the entire length of the bracket 2. Nail slots 62 are punched or otherwise formed in a lower portion of the web 40. The slots 62 extend lengthwise with respect to the web 40 and are also spaced an equal distance apart along a single line extending the entire length of the bracket 2. The nail slots 62 are sized, shaped and spaced on the web 40 to correspond to the size, shape and spacing of nail slots 26 of the panel 5 which is to be secured to the bracket 20

The siding attachment brackets 2 may be cut or formed to any length but are preferably cut to a length generally equal to the length of the wall 6 or surface onto which the siding panels 5 are to be attached.

Figure 5:
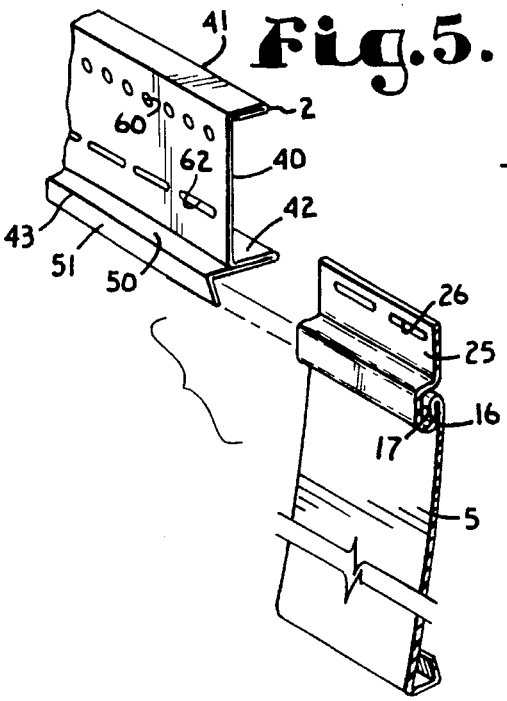
FIG. 5 is a fragmentary and exploded perspective view generally showing attachment of a siding panel to a siding bracket by sliding the panel onto the bracket.
Figure 6:
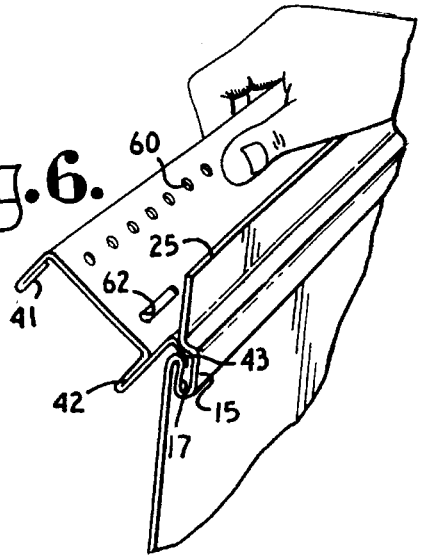
FIG. 6 is a fragmentary perspective view showing securement of a siding panel to a siding bracket of the present invention generally by snapping the panel onto a support shoulder of the bracket.

In use, the siding support shoulder 43 is positionable in the upwardly and rearwardly opening L-shaped channel 17 such that the panel 5 is generally supported on the horizontal leg 50 of the bracket 2 and free to advance along the length of the horizontal leg 50 such as through expansion and contraction. A panel 5 may be secured to the bracket 2 by sliding the siding support shoulder 43 through the upwardly and rearwardly opening L-shaped channel 17 of the panel 5 from one end thereof as generally shown in Fig. 5. A panel 5 may also be snapped into place on a bracket 2 as generally shown in FIG. 6. In such a procedure, a bracket 2 is generally aligned with a panel 5 along their lengths such that a leading edge of the vertical leg 51 of the siding support shoulder 43 extends into the upwardly and rearwardly opening L-shaped channel 17. The bracket 2 is then pulled forward with respect to the panel 5 such that the shoulder 43 advances into or "snaps" into the channel 17.

The siding clip 8 generally comprises a rigid but thin rectangular sheet having an upper portion 76 and a lower portion 77 and whose height corresponds to the height of the web 40. The width of the clip 8 preferably ranges from two to four inches. A pair of nail holes 78 are formed or punched in the upper portion 76 of the clip 8 to correspond to nail holes 60 in the web 40.

During installation of siding panels 5, a first bracket 2 is positioned along the lower edge of the outer wall 6 onto which the siding panels 5 are to be attached as shown in FIG. 2. A level can be positioned on top of the upper support leg 41 of the bracket 2 to level the bracket 2. Nails 85 or similar fasteners are driven through selected nail holes 60 for securing the bracket 2 to a wall 6 or other surface to which the siding panel 5 is to be secured. The nails 85 are preferably driven into framing studs 87 typically spaced on sixteen inch centers.

A siding panel 5 is then secured to a second bracket 2 through insertion of the bracket shoulder 43 into the channel 17 of the panel 5. The lower edge 9 of the panel 5 is then positioned such that the vertical leg 51 of the bracket 2 extends into the channel 11 formed along the lower edge 9 of panel 5. The second bracket 2, with the panel 5 secured thereto is then positioned against the wall 6, leveled and secured thereto by driving nails 85 through nail holes 60. This process is generally repeated up the wall 6 with the lower edge 9 of each successive panel 5 being positioned such that the downwardly projecting lip 15 of each lower panel 5 extends into the channel 11 of the next higher panel 5.

The interlocking arrangement of the lip 15 of one panel 5 with the upstanding inner leg 12 of the next higher panel 5 and the securement of each panel 5 to a bracket 2 through insertion of the shoulder 43 into the channel 17 is generally sufficient to prevent panels 5 from being separated from one another or the brackets 2 even from the forces exerted by relatively high winds. Further, angling the vertical leg 51 slightly inward from true vertical as shown in FIG. 4 provides a slight additional biasing force against the panel 5 for more firmly securing the panel 5 thereto.

Siding clips 8 are used to provide an even more secure attachment of a panel 5 to a bracket 2. In use, the clips 8 are positioned on the bracket 2 after a panel 5 has been secured to the bracket 2 and preferably after the bracket has been positioned against the wall 6 for securement thereto. The clips 8 are positioned such that nail holes 78 in the clip 8 align with nail holes 60 in the web 40. The clips 8 are generally spaced apart to align with the framing studs 87 in the wall 6 to which the system 1 is to be attached. As shown in FIG. 7, the upper portion 76 of the clip 8 is generally positioned flush against an upper portion of the web 40 and the lower portion 77 of the clip 8 generally abuts against the securement flange 25 of a panel 5 such that the securement flange 25 is generally positioned or sandwiched between the lower portion 77 of the clip 8 and a lower portion of the web 40. This arrangement does permit longitudinal movement of the siding panel 5 through expansion and contraction.

After the clip 8 is properly positioned nails 85 or other fasteners are driven through nail holes 78 in the clip 8 and nail holes 60 in the bracket 2 and into the wall 6 and stud 87. Nails 85 are preferably driven until the nail heads are flush against the clips 8 or against the web 40 when clips are not used such that the bracket 2 is fixedly secured to the wall 6.

The system 1 is adapted for use with siding panels 5 which have nail slots 26 in the securement flange 25 as shown in FIG. 3 or for panels 5 which do not have nail slots 26 in the securement flange 25 as shown in FIG. 7. When the system 1 is used with panels 5 having nail slots 26 in flange 25 it is sometimes desirable to drive a nail 27 through at least one set of corresponding nail slots 26 and 62 in the panel 5 and bracket 2 respectively and into the wall 6. A gap should be left between the head of the nail 27 and the flange 25 to permit longitudinal movement of the panel 5 at least the distance of the slot 26. Use of one nail 27 in this manner prevents excessive longitudinal movement of a panel 5 over time.

Figure 8:
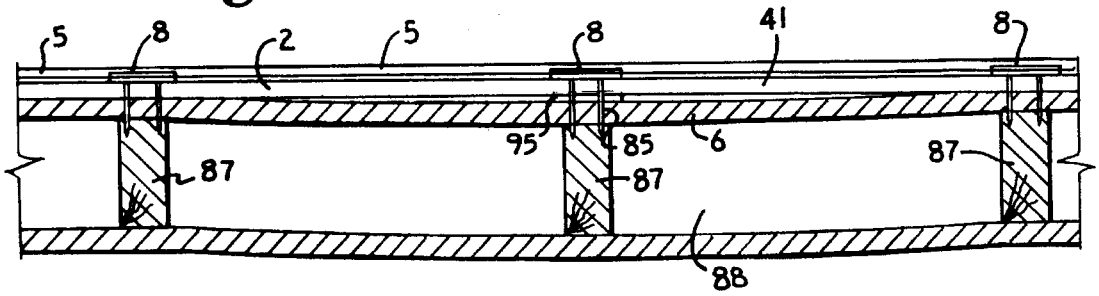
FIG. 8 is a reduced and fragmentary cross-sectional view generally taken along line 8—8 of FIG. 7 showing the siding attachment system of the present invention supporting a siding panel on a wall having an uneven surface.

The rigidity of the bracket 2 prevents the bracket 2 from conforming to the contours and irregularities in the wall 6 to which it is secured such that a siding panel 5 secured thereto generally presents a flat surface as opposed to an undulating or wavy surface as generally shown in FIG. 8. FIG. 8 demonstrates a situation wherein framing studs 87 are unevenly positioned causing an inwardly directed bow in the outer wall 6 of a building. The uneven positioning of the studs 87 may be caused by use of a warped baseplate 88, imprecise placement of the studs 87 on the baseplate 88 or for other reasons as more fully discussed above. The bracket 2 spans the bow to prevent an even structure or surface for supporting a siding panel 5. A shim or wedge 95 may be positioned between the bracket 2 and wall 6 for additional support, particularly where nails 85 are to be driven through the bracket 2 and into the wall 6.

Support of the siding panels 5 by bracket 2 along the entire length of the panels 5 also eliminates uneven sagging which occurs in systems wherein the siding panels are supported solely by clips or nails typically spaced sixteen inches apart along the studs 87.

It is to be understood that while certain forms of the present invention have been illustrated and described herein, it is not to be limited to the specific forms or arrangement of parts described and shown.

What is claimed and desired to be secured by Letters Patent is as follows:

1. A siding attachment system including a siding attachment bracket; said bracket comprising:

a. a generally vertically extending web having a plurality of holes formed in an upper portion of said web and extending across said web in linear alignment and having a plurality of slots formed in a lower portion of said web and extending lengthwise in linear alignment across said web;

b. at least one support leg extending rearwardly from said web; and c. a siding support shoulder including a horizontal leg and a vertical leg; said horizontal leg connected to said web at a first end, extending forwardly from said web and ending at a distal end; said vertical leg extending downwardly from said distal end of said horizontal leg.

2. The siding attachment system as in claim 1 wherein:

a. there are at least two of said support legs comprising a first support leg extending rearwardly from an upper end of said web and a second support leg extending rearwardly from a lower end of said web.

3. The siding attachment system as disclosed in claim 2 wherein said vertical leg of said support shoulder is angled rearwardly at an acute angle.

4. The siding attachment system as disclosed in claim 2 further including:

(a) a siding attachment clip comprising a planar sheet having an upper portion and a lower portion and whose height is approximately equivalent to the height of said web; said clip having at least one hole formed in said upper portion thereof and positioned to be alignable with one of said holes formed in said web when said upper portion of said clip is positioned in abutting relationship with said upper portion of said web.

5. The siding attachment system as disclosed in claim 1 wherein said vertical leg of said support shoulder is angled rearwardly at an acute angle.

6. The siding attachment system as disclosed in claim 1 further including a siding attachment clip; said clip comprising an upper section and a lower section; said upper section of said clip being securable to said upper section of said web.

7. The siding attachment system as disclosed in claim 1 further comprising means connected to said bracket for attaching said bracket to a wall.

8. The siding attachment system as disclosed in claim 1 further including:

(a) a siding attachment clip comprising a planar sheet having an upper portion and a lower portion and whose height is approximately equivalent to the height of said web; said clip having at least one hole formed in said upper portion thereof and positioned to be alignable with one of said holes formed in said web when said upper portion of said clip is positioned in abutting relationship with said upper portion of said web.

9. A siding attachment system including a siding attachment bracket in combination with a siding panel wherein;

a. said siding panel includes;

i. an upper and a lower edge and a front and a rear surface;

ii. said lower edge of said panel extending rearwardly and then upwardly to form an upwardly opening longitudinal channel;

iii. a forwardly and downwardly projecting longitudinal lip projecting forwardly away from the front surface of said panel and downwardly therefrom to form a downwardly opening channel;

iv. an upwardly and rearwardly opening L-shaped longitudinal channel formed in said lip and opening to said rear surface of said panel; and v. a flange extending above said lip and forming said upper edge of said panel; and b. said bracket is elongate and comprises:

i. a generally vertically extending web;

ii. a first support leg extending rearwardly from said web;

iii. a siding support shoulder including a horizontal leg and a vertical leg; said horizontal leg connected at a first end to said web and extending forwardly from said web and ending at a distal end thereof; said vertical leg extending downwardly from said distal end of said horizontal leg; said shoulder is sized for insertion into said upwardly and rearwardly opening L-shaped longitudinal channel such that said shoulder supports said panel but permits longitudinal slidable movement of said panel on said bracket.

10. The siding attachment system as in claim 9 wherein:

a. said bracket is at least approximately sixteen inches long.

11. The siding attachment system as in claim 9 wherein said first support leg extends rearwardly from an upper end of said web and said bracket further comprises:

a. a second support leg extending rearwardly from a lower end of said web.

12. The combination as disclosed in claim 9 wherein said vertical leg of said support shoulder is angled rearwardly at an acute angle.

13. The combination as disclosed in claim 9 further including:

(a) a siding attachment clip comprising a planar sheet having an upper portion and a lower portion and whose height is approximately equivalent to the height of said web; and (b) means for securing said clip to said bracket after said panel is secured to said bracket such that said lower portion of said clip is positioned over said panel flange such that said flange extends between said lower portion of said clip and a lower portion of said web.

14. The combination as disclosed in claim 9 wherein;

(a) a plurality of holes are formed in an upper portion of said web of said bracket; said holes extending across said web in linear alignment and sized for insertion of a fastener therethrough for securing said bracket to a wall.

15. The combination as disclosed in claim 14 wherein a plurality of slots are formed in a lower portion of said web of said bracket; said slots extending lengthwise in linear alignment across said web.

16. The combination as disclosed in claim 14 further including:

(a) a siding attachment clip comprising a planar sheet having an upper portion and a lower portion and whose height is approximately equivalent to the height of said web; said clip having at least one hole formed in said upper portion thereof and positioned to be alignable with one of said holes formed in said web when said upper portion of said clip is positioned in abutting relationship with said upper portion of said web such that said lower portion of said clip is positioned over said panel flange such that said flange extends between said lower portion of said clip and a lower portion of said web.

17. A siding attachment system including a siding panel in combination with a siding attachment bracket for attaching said siding panel to a wall which includes a plurality of studs generally spaced apart a uniform distance between centers of said studs and wherein;

a. said siding panel includes;

i. an upper and a lower edge and a front and a rear surface;

ii. said lower edge of said panel extending rearwardly and then upwardly to form an upwardly opening longitudinal channel;

iii. a forwardly and downwardly projecting longitudinal lip projecting forwardly away from the front surface of said panel and downwardly therefrom to form a downwardly opening channel;

iv. an upwardly and rearwardly opening L-shaped longitudinal channel formed in said lip and opening to said rear surface of said panel; and v. a flange extending above said lip and forming said upper edge of said panel; and b. said bracket is adapted to be at least as long as said uniform distance between centers of said studs and comprises:

i. a generally vertically extending web;

ii. a first support leg extending rearwardly from said web;

iii. a siding support shoulder including a horizontal leg and a vertical leg; said horizontal leg connected at a first end to said web and extending forwardly from said web and ending at a distal end thereof; said vertical leg extending downwardly from said distal end of said horizontal leg; said shoulder is sized for insertion into said upwardly and rearwardly opening L-shaped longitudinal channel of one of said siding panels such that said shoulder supports said panel but permits longitudinal slidable movement of said panel on said bracket.

18. The siding attachment system as in claim 17 wherein said first support leg extends rearwardly from an upper end of said web and said bracket further comprises:

a. a second support leg extending rearwardly from a lower end of said web.

19. The combination as disclosed in claim 18 wherein said vertical leg of said support shoulder is angled rearwardly at an acute angle.

20. The combination as disclosed in claim 18 further including:

a. a siding attachment clip comprising a planar sheet having an upper portion and a lower portion and whose height is approximately equivalent to the height of said web; and b. means for securing said clip to said bracket after said panel is secured to said bracket such that said lower portion of said clip is positioned over said panel flange such that said flange extends between said lower portion of said clip and a lower portion of said web.

21. The combination as disclosed in claim 18 wherein;

a. a plurality of holes are formed in an upper portion of said web of said bracket; said holes extending across said web in linear alignment and sized for insertion of a fastener therethrough for securing said bracket to a wall.

22. The combination as disclosed in claim 18 wherein a plurality of slots are formed in a lower portion of said web of said bracket; said slots extending lengthwise in linear alignment across said web.

23. The combination as disclosed in claim 18 further including:

a. a siding attachment clip comprising a planar sheet having an upper portion and a lower portion and whose height is approximately equivalent to the height of said web; said clip having at least one hole formed in said upper portion thereof and positioned to be alignable with at least one hole formed in said web when said upper portion of said clip is positioned in abutting relationship with an upper portion of said web such that a lower portion of said clip is positioned over said panel flange such that said flange extends between said lower portion of said clip and a lower portion of said web.

* * * * *